United States Patent [19]

Savich

[11] 4,187,572

[45] Feb. 12, 1980

[54] METHOD FOR MAKING INTEGRATED BOOK LINING

[75] Inventor: Peter P. Savich, Longmeadow, Mass.

[73] Assignee: The Smyth Manufacturing Company, Bloomfield, Conn.

[21] Appl. No.: 883,728

[22] Filed: Mar. 6, 1978

Related U.S. Application Data

[63] Continuation-in-part of Ser. No. 785,964, Apr. 8, 1977, abandoned.

[51] Int. Cl.[2] ..... B42C 15/00

[52] U.S. Cl. ..... 11/2; 11/1 R; 281/28; 93/1 F; 156/267

[58] Field of Search ..... 11/1 R, 2, 1 AC, 1 AD; 93/1 E, 1 F, 350 S; 281/21 R, 23, 28, 15 R; 156/178, 202, 257, 267, 270, 271, 277, 477 B

[56] References Cited

U.S. PATENT DOCUMENTS

| | | | |
|---|---|---|---|
| 1,225,886 | 5/1917 | Strobel | 281/28 |
| 1,665,049 | 4/1928 | Baker | 281/28 |
| 1,845,725 | 2/1932 | Schmidt | 11/1 R |
| 1,865,557 | 7/1932 | Clark | 11/1 R |
| 2,382,877 | 8/1945 | Heilbrunn et al. | 93/1 F |
| 3,956,049 | 5/1976 | Johnsen | 156/267 X |

*Primary Examiner*—Robert L. Spicer, Jr.
*Attorney, Agent, or Firm*—Donald J. Hayes; R. William Reinsmith

[57] ABSTRACT

In making integrated linings to be applied to spines of a succession of books in a bookmaking process, a high speed low cost method is disclosed which includes feeding strip stock from a supply of lining material, printing simulated headbands on one surface of that strip adjacent its longitudinal side edges and cutting the strip transversely to its longitudinal axis to form a succession of individual linings to be applied to spines of a succession of books.

32 Claims, 46 Drawing Figures

FEED

TRIM

PRINT

SCORE

GLUE

APPLY CORD AND EDGE FOLD

HEAT

PUNCH

CUT

GLUE

EDGE FOLD

HEAT

CORNER RELIEF

PERFORATE

CUT

METHOD FOR MAKING INTEGRATED BOOK LINING

This application is a continuation-in-part of Ser. No. 785,964, filed Apr. 8, 1977, which is now abandoned.

This invention relates to a method for backlining books and particularly concerns a new and improved method for forming an integrated lining to be applied to a spline of a book.

A primary object of this invention is to provide a new and improved method of making an integrated lining for a book which method is particularly suited for use in high speed automatic bookmaking operations.

Another object of this invention is to provide such a new and improved method particularly suited to meet low cost, high production requirements.

A further object of this invention is to provide a method of the above described type which features use of a minimum amount of material.

Yet another object of this invention is to provide such a method which not only is adapted for use by new automated machines but it is quick and easy to be used in modified existing bookmaking equipment for bookmaking operations characterized by trouble-free reliable processing for high speed, low cost mass production of books.

Other objects will be in part obvious and in part pointed out more in detail hereinafter.

A better understanding of this invention will be obtained from the following detailed description and the accompanying drawings of an illustrative application of this invention.

Figure 12:
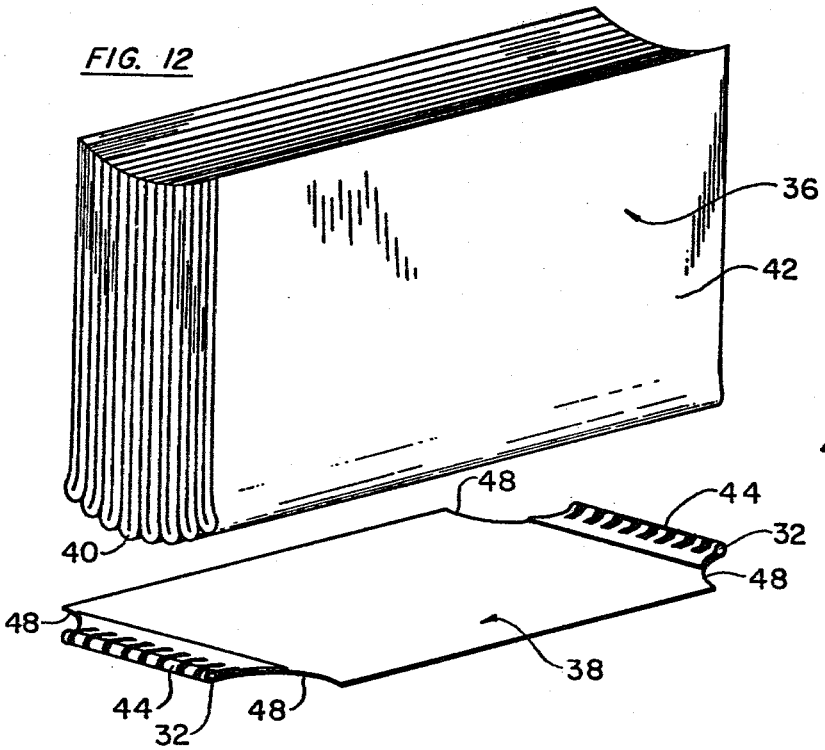
Figure 13:
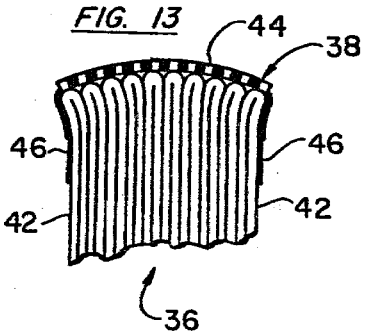
Figure 21:
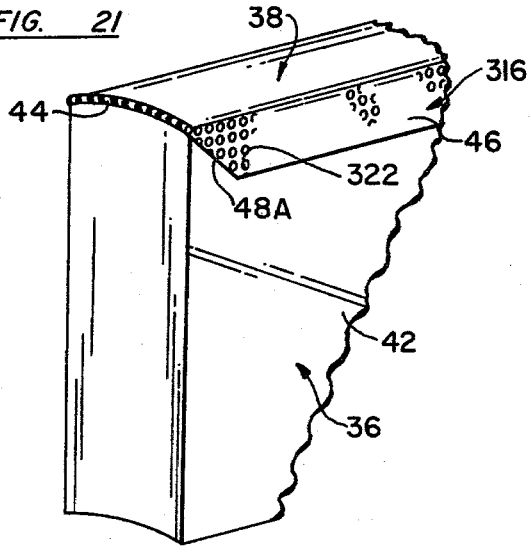
Figure 14:
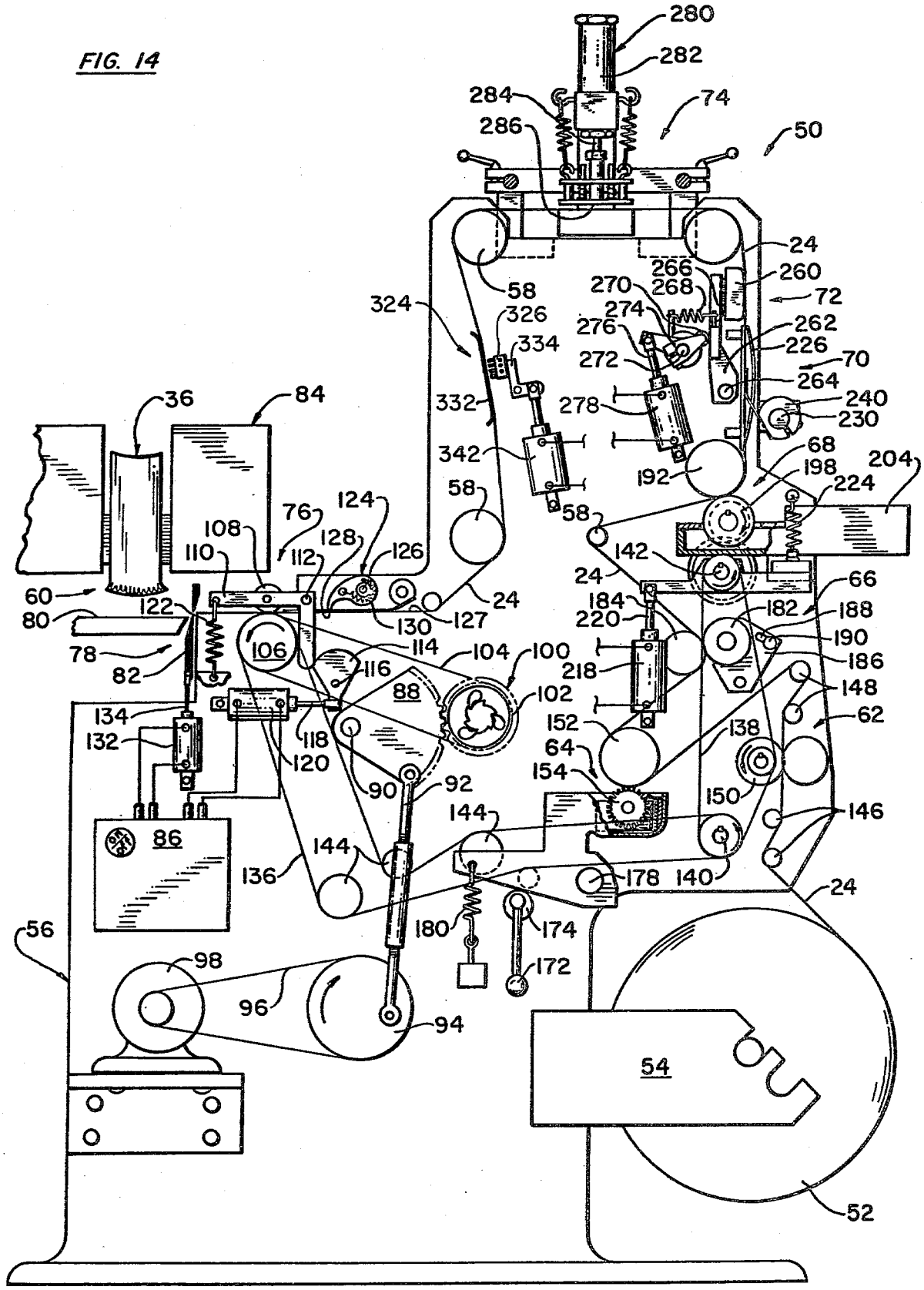
Figure 15:
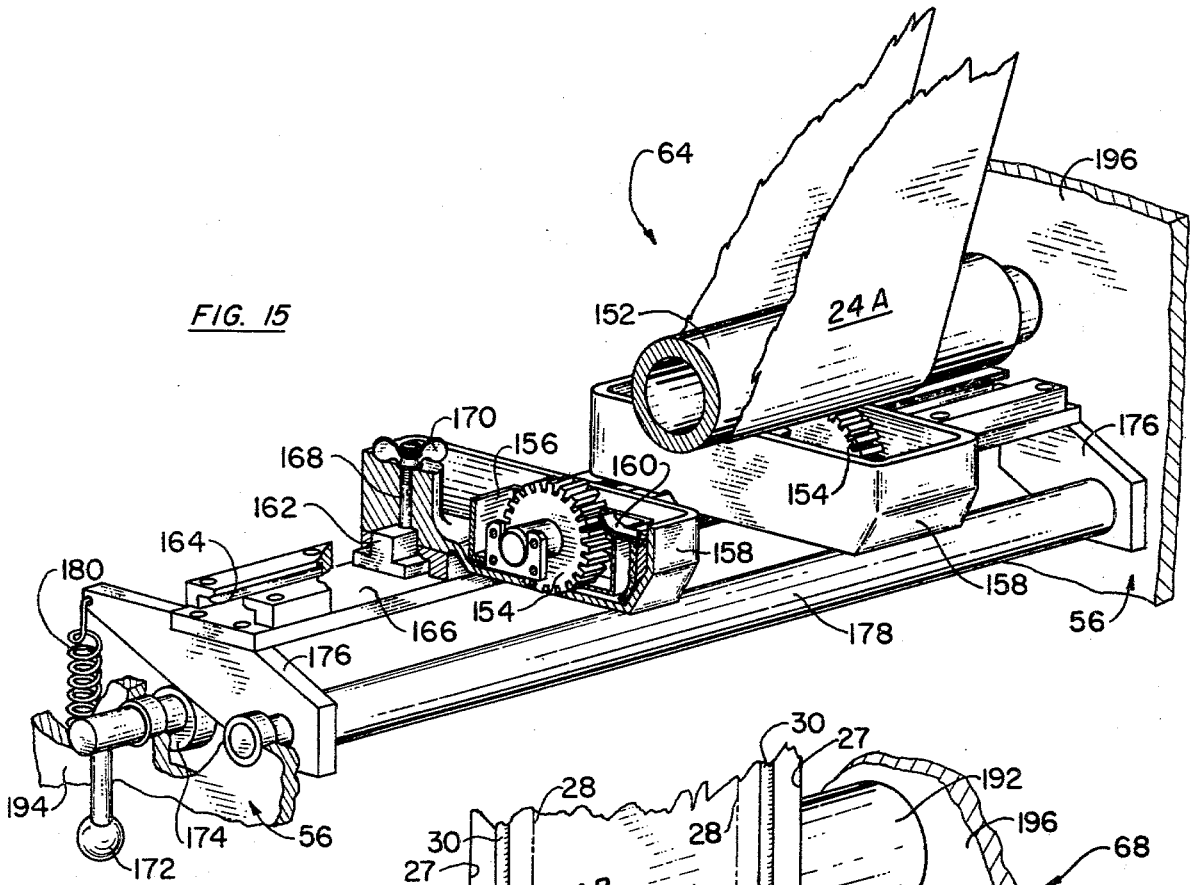
Figure 16:
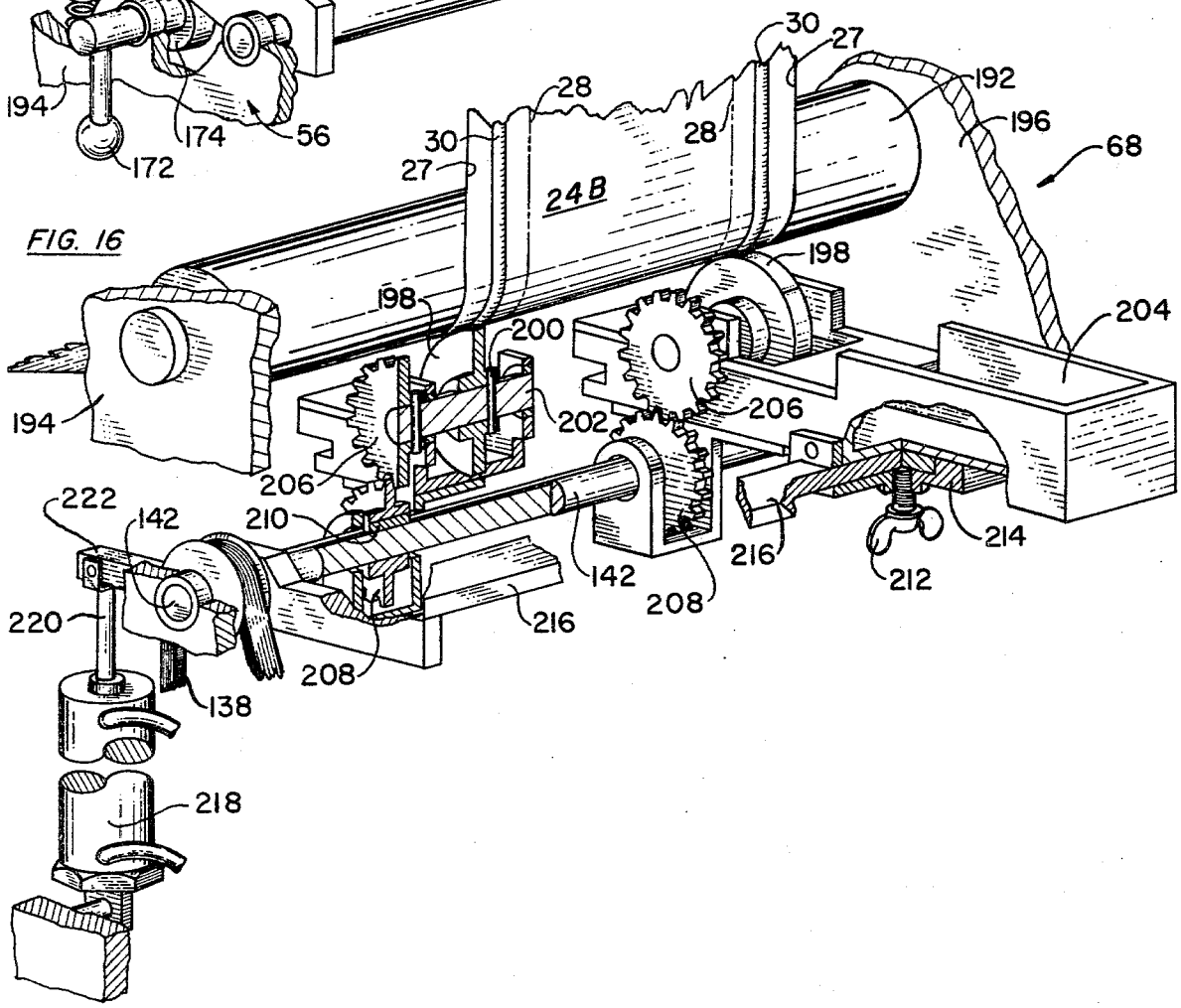
Figure 17:
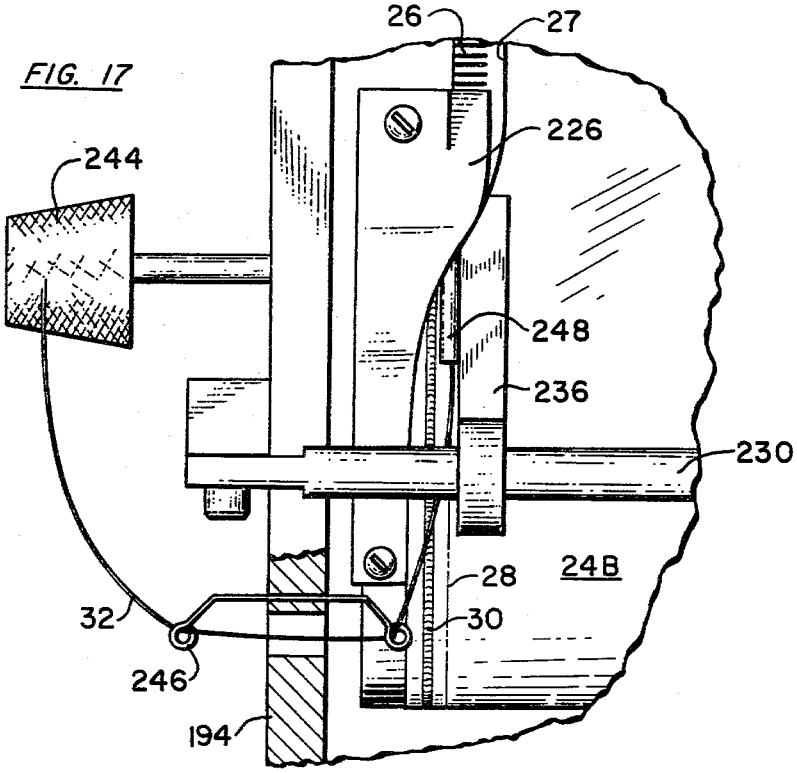
Figure 20:
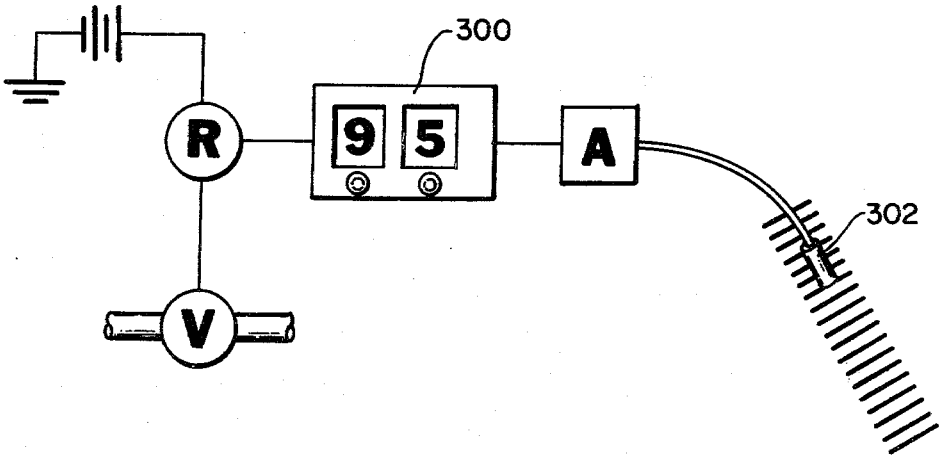
Figure 18:
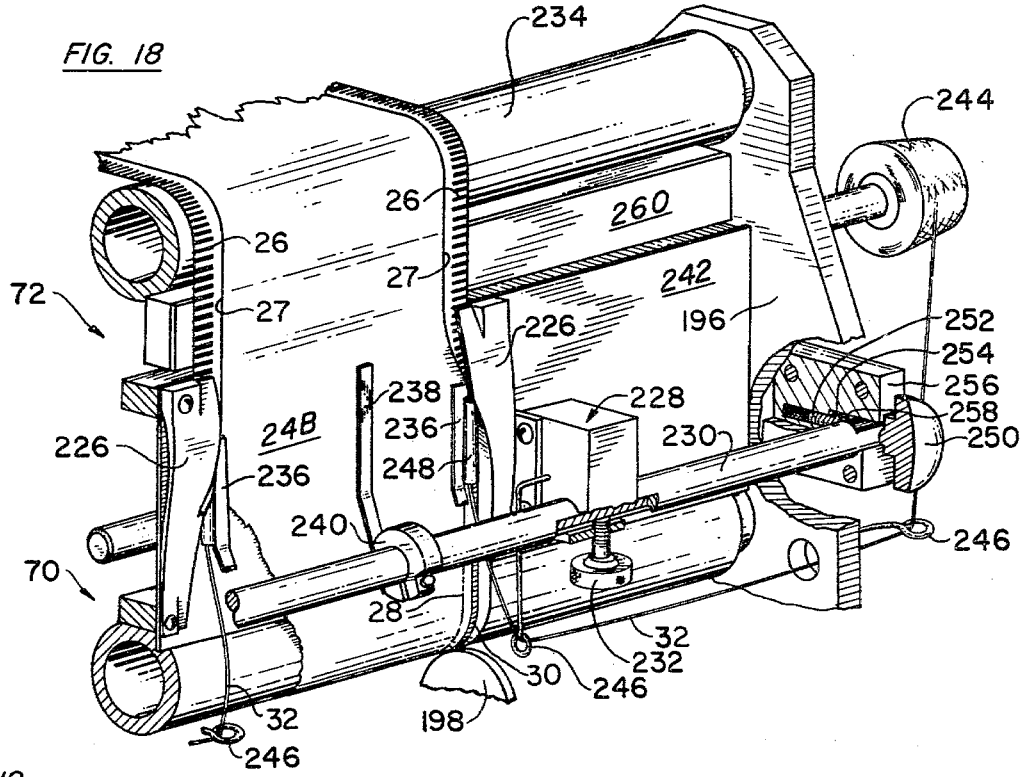
Figure 19:
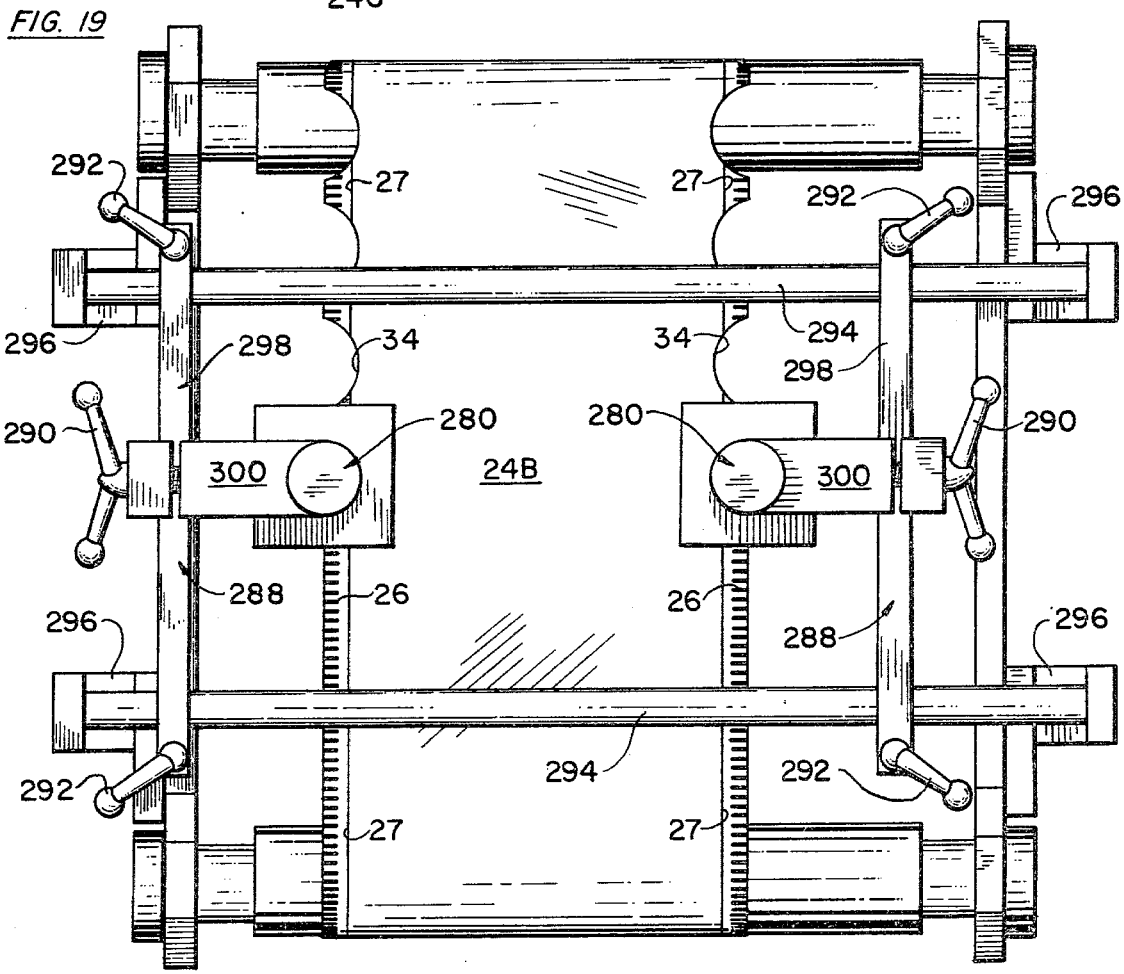
Figure 22:
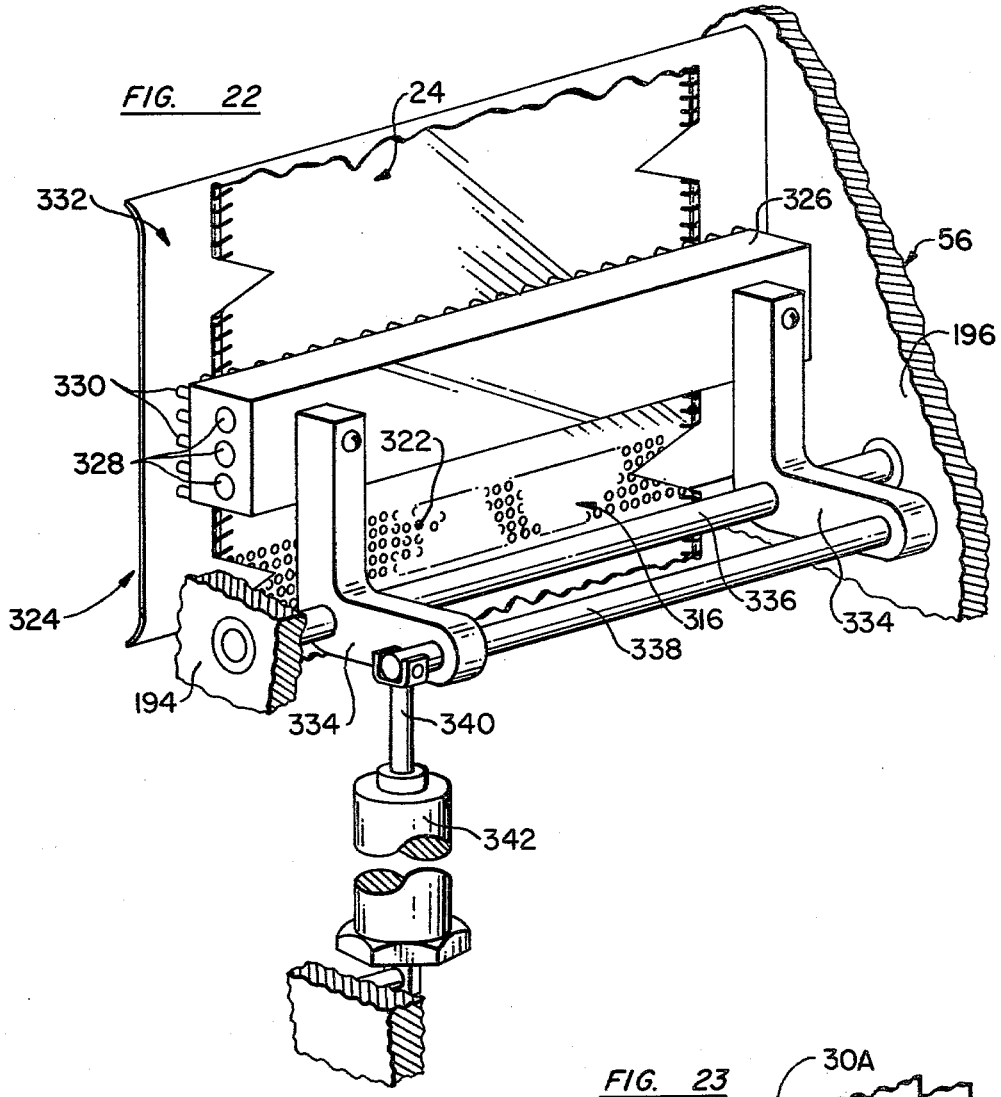
Figure 23:
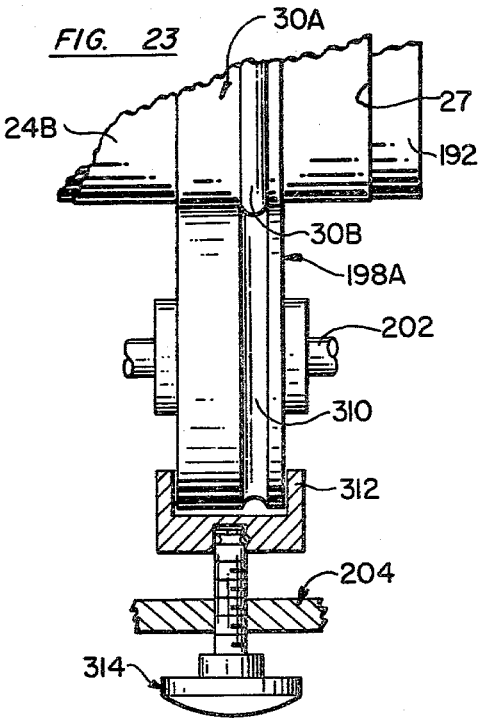
Figure 24A:
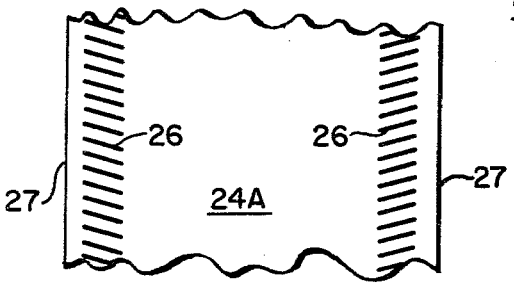
Figure 24B:
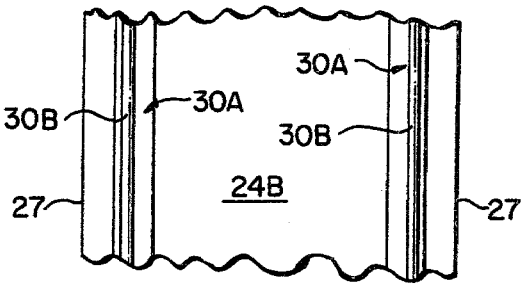
Figure 24C:
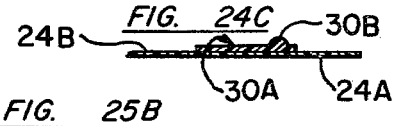
Figure 25A:
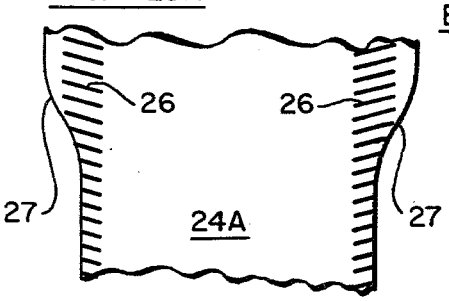
Figure 25B:
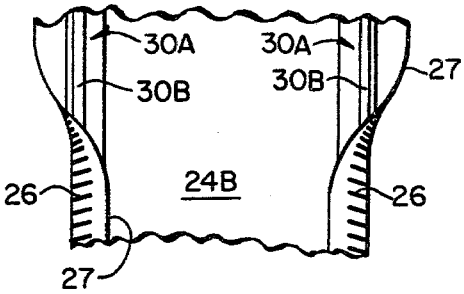
Figure 25C:
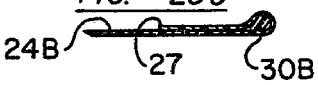
Figure 26A:
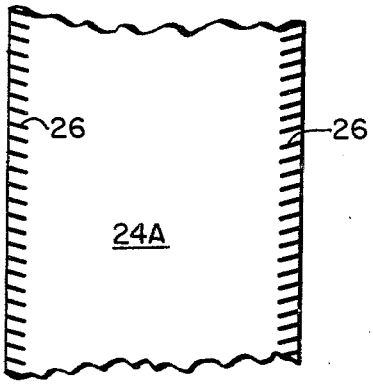
Figure 26B:
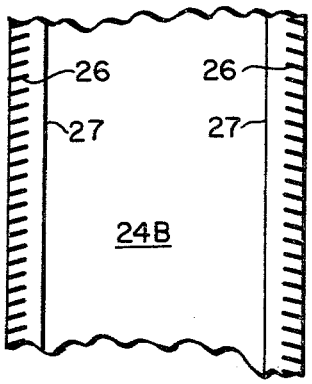

FIGS. 3A through 11B inclusive are diagrammatic representations of steps in making a lining of this invention;

FIG. 12 is an isometric view of a book and an integrated lining of this invention in disassembled relation prior to being joined in registered relation to one another;

FIG. 13 is an end view of a book, partly broken away, which has the integrated lining of FIG. 12 attached;

FIG. 14 is a side elevational view, partly broken away and partly in section, schematically showing a bookmaking apparatus of this invention;

FIG. 15 is an enlarged isometric view, partly broken away and partly in section, of a printing station incorporated in the apparatus of FIG. 14;

FIG. 16 is an enlarged isometric view, partly broken away and partly in section, of a glue station incorporated in the apparatus of FIG. 14;

FIG. 17 is an enlarged front view, partly broken away and partly in section, illustrating certain components of an edge folding station incorporated in the apparatus of FIG. 14;

FIG. 18 is an enlarged isometric view, partly broken away and partly in section, of the edge folding station;

FIG. 19 is a top view of a punching station incorporated in the apparatus of FIG. 14;

FIG. 20 is a schematic view of an alternative arrangement for controlling lining feed;

FIG. 21 is an isometric view, partly broken away, of another embodiment of an integrated lining of this invention in assembled relation to a book;

FIG. 22 is an enlarged isometric view, partly broken away and partly in section, of a perforating station incorporated in the apparatus of FIG. 14;

FIG. 23 is an enlarged front view, partly broken away, showing details of a glue roll incorporated in the apparatus of FIG. 14; and FIGS. 24A through 29B inclusive diagramatically illustrate another embodiment of a series of steps in making a lining of this invention.

Figure 1:
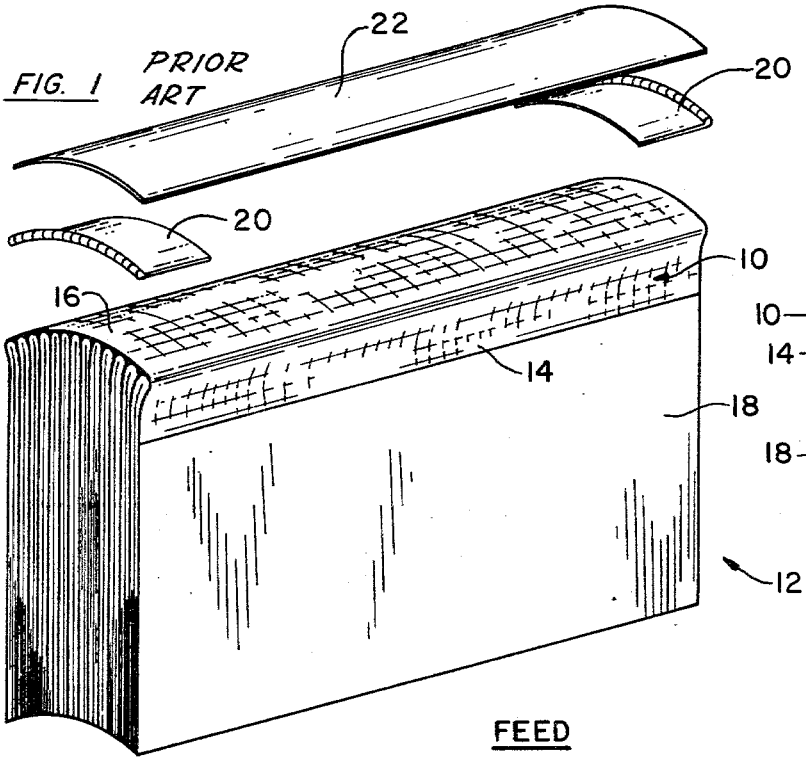
FIG. 1 PRIOR ART
FIG. 1 is an isometric view showing parts of a conventional lining in disassembled relation to a book.
Figure 2:
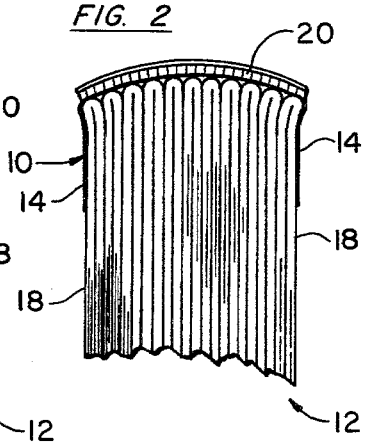
PRIOR ART FIG. 2
FIG. 2 is an end view, partly broken away, of a book having a conventional lining applied of the type illustrated in FIG. 1.

Referring to the drawings in detail, a conventional three element combination lining construction for a book is illustrated in FIGS. 1 and 2. FIG. 1 shows various parts of a disassembled lining. A conventional woven material commonly referred to as "crash" 10, similar to a tough, coarse cheesecloth, is glued to the book 12 with side flaps 14 of the crash 10 lapping over a crowned spine 16 and extending along each face sheet 18 of the book 12. The extent of the crash flaps 14 along the face sheets 18 typically measure about $\frac{7}{8}$ inch such that the overall width of the crash 10 is equal to two times $\frac{7}{8}$ plus the thickness of the spine 16. The crash 10, which is glued to the book spine 16, has individually customized headband strips 20 applied by yet another separate glueing operation to a conventional backing 22, normally so-called "kraft" paper. The backing 22 is applied in registered relation to the book spine 16 and overlaps both the headband strips 20 and underlying crash 10 to form the conventional lining for the book, it being understood that the backing 22 again is required to be applied to the spine 16 by yet a further gluing operation.

The above described conventional lining utilizes three separate and costly materials in addition to multiple layers of adhesives all of which have become increasingly expensive. The per unit cost of books can be significantly reduced by simply eliminating multiple gluing operations and even more significant cost savings are achieved by the elimination of the above described conventional three element backlining. Concomitant cost savings have been found to be achieved by eliminating conventional machine components and the normally required multi-operational steps by providing an integrated lining in accordance with this invention.

In FIGS. 3–11, inclusive, individual manufacturing steps are graphically illustrated in the method of making the integrated lining of this invention. The lefthand column of each of the figures designated "A" depicts an outer surface 24A of a strip 24 of lining material. The righthand column of the respective figures designated "B" represent an opposite inner strip surface 24B. It is to be understood that the method of making the integrated linings of this invention entails manufacture of a series of identical linings to be ultimately attached to a succession of books each of identical size corresponding to the linings. Adjustment of the lining size is readily made before a production run during machine set up for books of particular sizes.

Figure 3A:
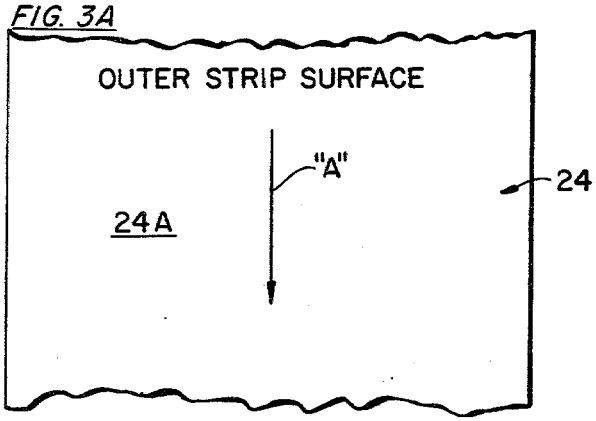
Figure 3B:
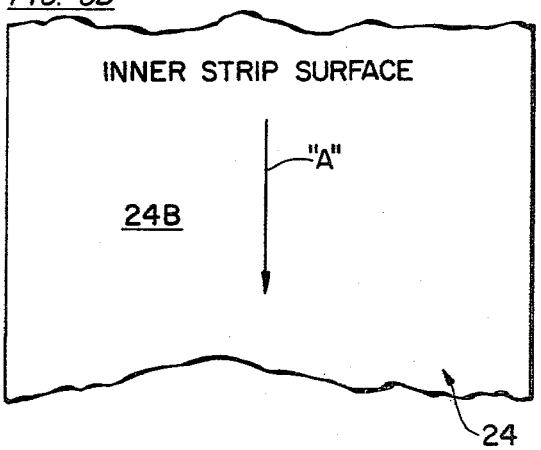
Figure 4A:
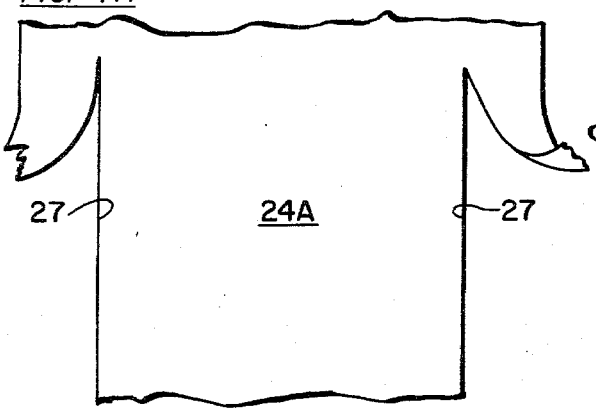
Figure 4B:
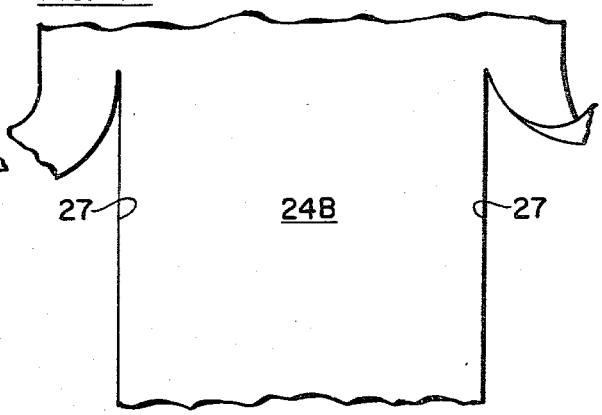

Strip stock is paid-off a supply roll to be fed along a feed path extending in the direction of the longitudinal axis of the strip in the direction of arrows "A" in FIG. 3 through a series of progressive operational stations. The strip stock material may be any one of a number of selected tough, durable webs or sheets of relatively lightweight construction exhibiting dimensional stability under varying atomspheric conditions, good printability and good ink adhesiveness. While various types of materials are suited for the application of this invention, a synthetic material found to perform satisfactorily is a spunbonded olefin of high density polyethylene fibers marketed under the trademark "Tyvek" by E. I. duPont de Nemours and Co., Inc. Tyvek spunbonded olefin exhibits lightweight, smooth surface and high opacity characteristics as well as being tough and durable and is suited to provide a printable substrate in either web or sheet form.

Figure 5A:
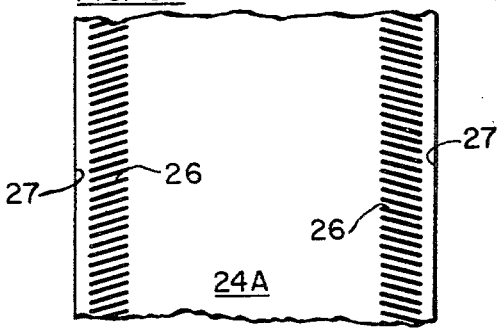
Figure 5B:
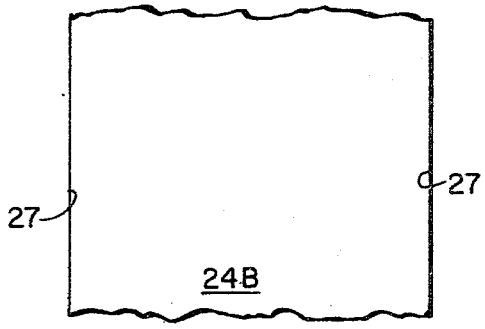
Figure 6A:
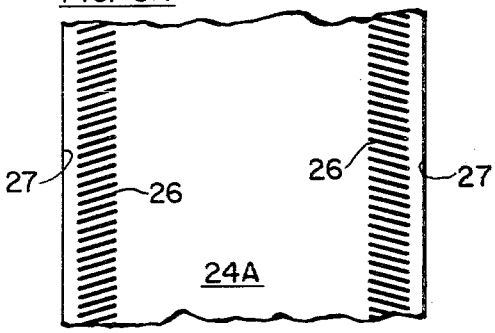
Figure 6B:
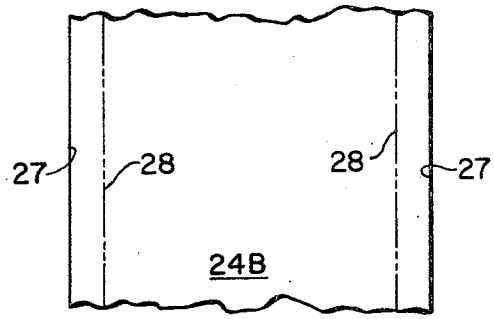

Upon paying off a strip of such material, the strip 24 is trimmed (FIG. 4) to a width generally corresponding to the length of the book spines to which the integrated lining is to be applied, plus twice a predetermined fold-over as described below. After trimming, the strip 24 is then fed to a downstream printing station. At the printing station, the outer surface 24A of the strip 24 is printed to form a continuous pattern 26 of simulated headbands parallel to and adjacent each longitudinal edge 27 of the strip, as best seen in FIG. 5, before the strip 24 is fed into a crimping station.

At the crimping station, fold lines 28 (FIG. 6) are scored on the strip within the printing zones or patterns 26 of its simulated headbands in adjacent parallel relation to each of its longitudinal edges along the inner surface 24B of the strip opposite its printed surface. The scoring is effected to provide fold lines 28 spaced aprat a distance substantially equal to the length of the book spines which are to be provided with backlinings.

Figure 7A:
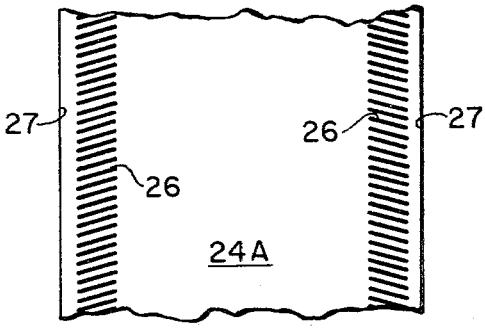
Figure 7B:
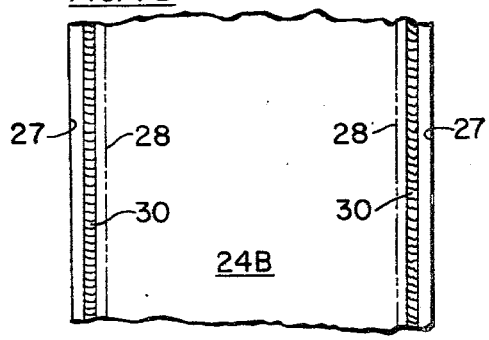
Figure 8A:
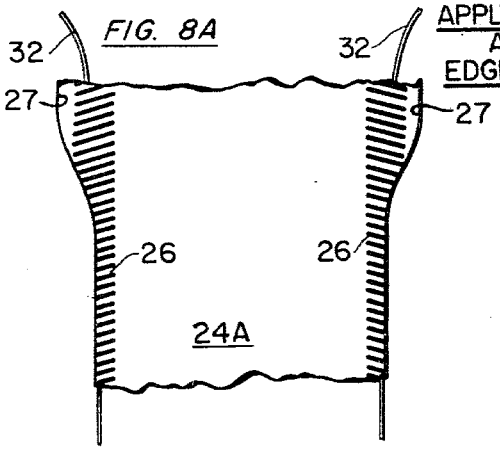
Figure 8B:
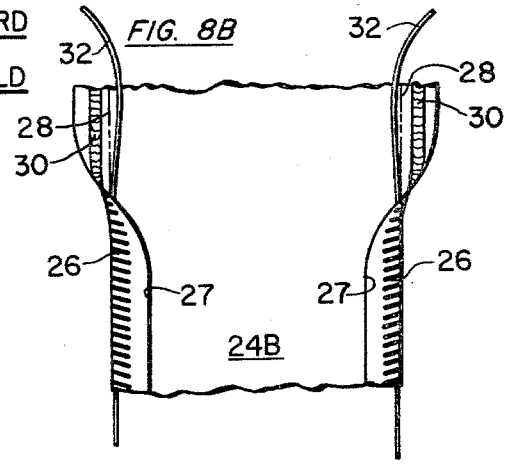
Figure 9A:
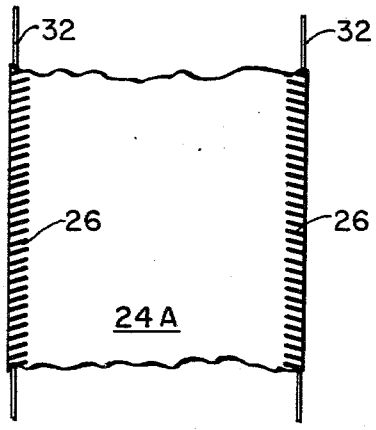
Figure 9B:
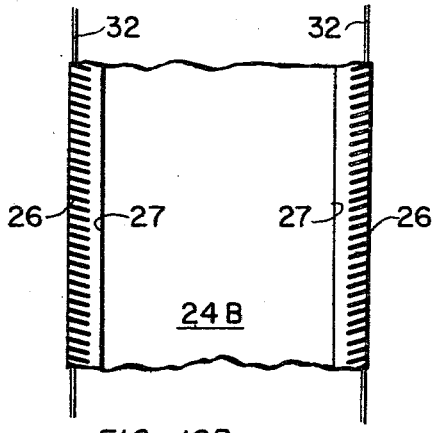
Figure 10A:
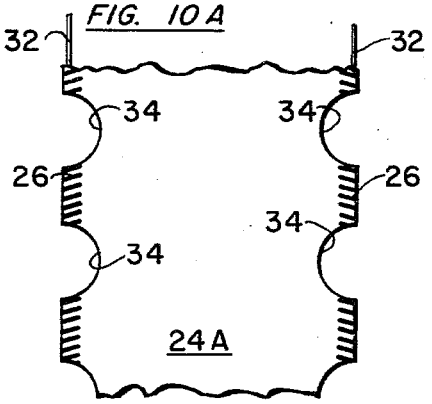
Figure 10B:
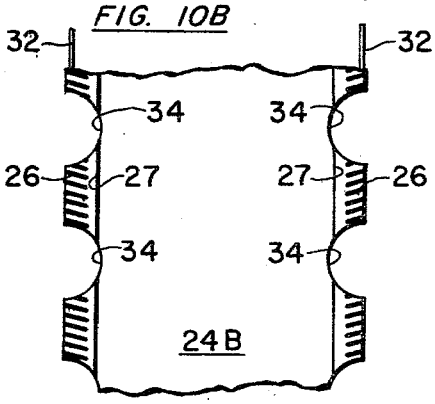
Figure 11A:
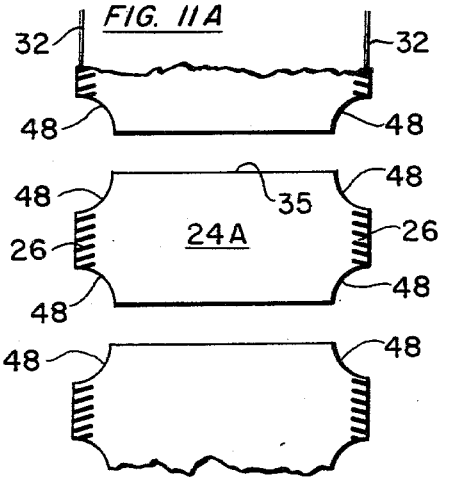
Figure 11B:
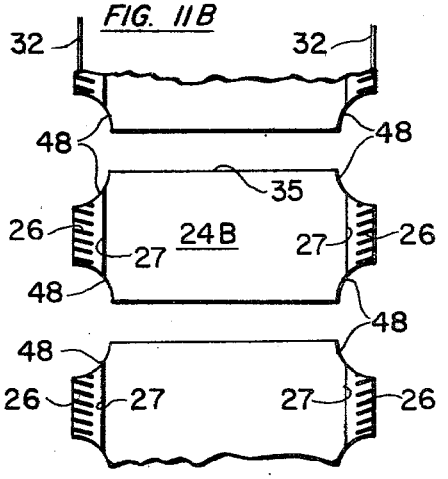

The strip 24 then passes through an adhesive applicator which preferably applies a hot melt adhesive in a continuous thin molten bead 30 in parallel relation to the longitudinal side edges on the inner surface 24B of the strip 24 (FIG. 7). In the preferred embodiment, the adhesive beads 30 along each strip side edge are illustrated as being disposed between their respective side edge of the strip and adjacent scoring line 28.

The trimmed, printed and scored strip 24 is then fed to a downstream edge folding station (FIG. 8), and the glue laden inner side edges of the strip 24 are folded toward one another. By folding over the side edges of the strip along their scored fold lines 28, the outer printed edge surfaces are exposed to simulate headbands on each side of the lining at its opposite edges, respectively, with a folded strip dimension extending crosswise of the strip's longitudinal axis substantially equal to the book spine length.

To provide desired added bulk to the simulated headbands, cord 32 is preferably fed onto the inner surface of the strip 24 along each of its side edges to be drawn through the folding station in unison with the strip such that the cord 32 is secured along the fold lines 28 within each folded edge upon the adhesive bonding the confronting inner folded surfaces at opposite side edges of the strip 24.

A property of Tyvek spunbonded olefin is a melting point of about 275° F. Available hot melt adhesives normally have significantly higher melting point temperatures than spunbonded olefin and many other suitable lining materials. By introducing a short time delay during transfer of adhesive at its melting temperature, say at 375° F., before applying it to the Tyvek strip permits the hot melt adhesive to cool to a reduced temperature, say, of about 275° F., before being applied to the lining. Despite its relatively low melting point, the Tyvek material has not been found to melt through since only its confronting inner surfaces are drawn into direct contact with the hot melt through the folding station. The hot melt adhesive not only cools rapidly but provides a bond very quickly.

It has also been found that use of hot melt adhesives having significantly reduced melting points approaching that of the lining material does not effectively bond the edges. However, by applying heat (FIG. 9) to the lining material and its hot melt (having similar melting points) downstream of the edge folding station serves to reactivate or remelt the adhesive to securely seal the folded edges in position.

To effect stress relief at each corner of the side flaps of the integrated lining of this invention as well as to promote improved adhesion of the lining to the book, the strip upon passing through the hot melt reactivating heating zone is fed into a punching station wherein equally spaced marginal cutouts 34 of substantially identical size are formed along each longitudinal side edge of the strip (FIG. 10) with the spacing between side edges measuring about $1\frac{3}{4}$ inch. The cutouts 34 on each edge of the strip are formed in opposed aligned relation to cutouts on the opposite edge of the strip. To match the simulated headbands to the ends of the book spines, the cutouts 34 are spaced apart to provide uniform uninterrupted longitudinal side edges between cutouts which are substantially equal in length to match the thickness of the book spines to which the linings are to be applied.

The lining material then moves into a cutting station wherein the strip is cut (FIG. 11) transversely to its longitudinal axis along a cutoff line 35 projecting between centers of the aligned cutouts on opposed strip edges to form substantially identical individual linings to be attached to book spines of substantially identical size.

Referring now to FIGS. 12 and 13, it will be understood that a series of books such as at 36 are each conveyed to a conventional lining station in synchronism with a corresponding series of linings 38 successively being fed onto a lining platform from the cutting station. Each book 36 arrives at the lining station with its crowned spine 40 and adjacent face sheets 42 coated with glue for attachment of a lining such as at 38 with its simulated headbands 44 registered with opposite ends of the spine 40 and the relieved side flaps 46 of the lining 38 extending along each face sheet 42.

As noted above, when the strip 24 moves through the punching station the cutouts are preferably formed by a circular punch, and the cutouts 34 so made serve to relieve the opposite ends of each of the lining side flaps 46 projecting beyond the headbands 44 to extend beyond the spine 40 of the book 36 and down along its face sheets 42. Such construction not only removes the ends of each flap 46 to promote better gluing of each flap to its face sheet, but needed stress relief is provided at each corner of the crowned book spine 40 in addition to providing a better appearance than would otherwise be achieved if the extending flaps were even with the simulated headbands.

The integrated lining 38 of this invention is accordingly formed from substantially planar strip stock and the ends of the lining on opposite sides of each simulated headband 44 are relieved with corner cutouts 48. The uninterrupted extent of the simulated headbands 44 extending between the corner cutouts 48 is substantially equal to the thickness of the book spine 40; the flap 46 on each side of the headbands 44 extends about $\frac{7}{8}$ inch; and the length of the lining 38 between the simulated headbands 44 is substantially equal to the length of the book spine to which the lining 38 is to be applied. Desired bulk for each simulated headband 44 is provided by the cord 32 extending along each of the fold lines 28 at opposite ends of each integrated lining 38.

To make such integrated linings in an efficient high production, low cost automatic process, a preferred embodiment of an apparatus incorporating this invention is generally denoted by the numeral 50 and is shown in a bookmaking maching installation in FIG. 14. A strip stock supply such as a roll 52 of the above described Tyvek material is mounted on an unwind assembly 54 fixed to a frame 56 to be paid out along a strip feed path. The feed path is defined by a multiplicity of guide and transport rolls such as at 58 schematically shown in the drawings and which will be understood to be journaled on frame 56 for rotation, with the strip trained over the rolls to be fed to a downstream lining station 60.

Apparatus 50 is shown comprising, in operative alignment along the strip feed path, trimming station 62, printing station 64 which is upstream of crimping station 66 from which the strip 24 is fed into downstream glue station 68. Upon emerging from glue station 68, strip 24 passes through edge folding station 70 and an adjacent glue reactivating station 72 before entering punching station 74 and passing through feed roll assembly 76 to a cutting station 78 immediately upstream of the lining station 60. A lining platform 80 receives the leading end of strip 24 and upon its being cut by knife 82, the lining platform 80 elevates the integrated lining 38 to apply it to an adhesively coated spine of book 36 which has been conveyed by a suitable drive 84 into position overlying platform 80. The drive 84 conveys book 36 and its integrated lining 38 along a path normal to the strip feed path. Downstream conventional means, not shown, apply pressure to secure lining 38 to the book spine and face sheets. If desired, the books 36 may then be passed through yet another downstream reactivating station, not shown, to again remelt the adhesive to effect a sturdy bond between the book 36 and its integrated lining 38.

The following summary of operation does not specifically describe certain details of various controls, fluid logic circuitry and piping arrangements located in control box 86 and which have been found to perform satisfactorily, for a variety of different circuits and controls may be employed in accordance with conventional techniques to effect operation on manual, semi-automatic or automatic program sequencing. A clear understanding of this invention will be obtained from the following description of the sequence of operation of the mechanical components with reference to the drawings, bearing in mind that upon actuating an ON/-OFF button to ON, the electrical and pneumatic control systems of apparatus 50 are energized to provide the described control functioning. In addition, the air cylinders for operating the mechanical components will be understood to be connected to a suitable source of compressed air through the lines schematically illustrated in FIG. 14 and connecting the cylinders to the control box 86.

In the preferred embodiment a drive gear segment 88 is supported for oscillating movement about a pin 90 fixed to frame 56. A drive link 92 is pivotally connected at its opposite ends to gear segment 88 and a rotary drive shaft 94 connected by belt 96 to be driven by electric motor 98. Drive gear segment 88 meshes with a drive clutch mechanism 100 providing a one-way rotary drive in a counterclockwise direction as viewed in FIG. 14 to an output shaft 102 connected by belt 104 to feed roll 106 of the feed roll assembly 76. Assembly 76 includes a backup ressure roll 108 supported on a bell crank 110 movable about pivot pin 112. A free end of bell crank 110 engages actuator 114 pivotally supported on frame 56 about a pin 116 and secured to a reciprocable piston rod 118 of a feed control air cylinder 120.

With the drive components of feed roll assembly 76 in the position illustrated in FIG. 14 and with the lining strip 24 disposed between feed roll 106 and its back-up pressure roll 108, angular movement of the rotary drive shaft 94 and the drive gear segment 88 in a clockwise direction drives feed roll 106 in a counterclockwise direction to feed a leading end of lining strip 24 past knife 82 onto lining platform 80.

Upon the drive gear segment 88 returning in a counterclockwise direction responsive to continued clockwise rotation of drive shaft 94, the drive clutch mechanism 100 arrests movement of drive belt 104. This action stops feed roll 106, thereby effecting a dwell in the strip feeding movement to lining platform 80. Should there by any upstream malfunction, jamming of the strip or no book 36 present to receive a lining, it is to be understood that the control system effect switching of the supply and exhaust to feed control air cylinder 120 to disable the feed roll assembly 76. Piston rod 118 extends from its illustrated retracted position and pivots bell crank 110 against its return spring 122 to lift pressure roll 108 out of engagement with strip 24.

To eliminate any undesired tendency of strip 24 being retracted when feed roll assembly 76 is disabled, a no-back hold-down device 124 is mounted on a bar 126 extending laterally across and above the feed path of strip 24 for urging the strip against a back-up plate 127 secured to frame 56 in the strip feed path. The no-back device 124 has a gripping foot 128 preferably grooved or serrated and has an adjustable spring 130 to effect a preselected positive grip on strip 24. When the supply and exhaust to the feed control cylinder 120 are once again switched by the control system, rod 118 is retracted into position illustrated in FIG. 14 to return pressure roll 108 into engagement with strip 24 under the bias of its return spring 122 connected to bell crank 110.

During normal machine cycling with the pressure roll 108 in its illustrated engaged position, the feed roll assembly 76 operates in timed synchronism to equal oscillating clockwise throws of drive gear segment 88 such that feed roll assembly 76 intermittently engages strip 24 for advancing successive lengths of strip 24 in uniform movements into cutting position on lining platform 80. A knife control cylinder 132 is power operated by the control systems to extend and retract its piston rod 134 to reciprocate knife 82 at the cutting station 78 during dwells between each advancing strip movement to cut off the leading end of strip 24 and retract knife 82 into its illustrated withdrawn starting position before the next feed movement in the machine cycle. Rotation of feed roll 106 in a counterclockwise direction effects a corresponding driving motion in a strip feeding direction to slave belts 136 and 138 which are connected to a common driven shaft 140 and trained over the feed roll 106 and a pulley on glue drive shaft 142, respectively, via secondary rolls 144.

As strip 24 is unwound from supply roll 52, the strip 24 passes over tensioning and tracking rollers 146, 148 and an intermediate slitting mandrel 150 driven by belt 138 and which trims strip 24 lengthwise to provide a strip width generally corresponding to the length of the book to which the lining is to be applied. In the preferred illustrated embodiment, this strip width exceeds by a predetermined amount the actual length of the book.

Following the trimming operation, strip 24 passes over an impression cylinder 152 best seen in FIG. 15 to engage a pair of printing wheels 154, 154 coaxilaly mounted in parallel adjacent relation to impression cylinder 152. To promote precision high quality printing of simulated headbands 26 on strip 24 parallel to and adjacent its opposite longitudinal side edges 27, each printing wheel 154 is journaled with a housing 156 for free-wheeling rotation, responsive to advancing strip movements, in isolated relation to a surrounding ink pot 158 for dry running. A suitable ink applicator such as a felt wick 160 is mounted between each pot 158 and its printing wheel 154 for controlled ink transfer therebetween and to wet the teeth of printing wheel 154 upstream of its engagement with strip 24 passing between impression cylinder 152 and printing wheel 154, 154 to effect the printing. Printing wheels 154, 154 may be provided with a variety of different tooth configurations to effect the desired simulation of a headband 26.

For adjusting the printing wheels 154, 154 laterally to accommodate strip widths of different size to form linings for book spines of different lengths, at least one of the printing wheels 154 and its ink pot 158 is provided with a releasable locking means such as the sliding T bar 162 within a complementary channel 164 on cross bar 166 and bolt 168 extending upwardly from the T bar 162 through a wall of the ink pot 158 to be secured in selected lateral position on the cross bar 166 upon tightening wing nut 170.

Upon machine shut-down and also during and prior to machine set-up, the printing wheels 154, 154 may be manually disengaged from contact with the strip 24. This action is effected upon turning a manual handle 172 connected to a cam 174 engaging an arm 176 mounted on a pivot rod 178 supported on frame 56 such that the printing station or mechanism 64 is rotated clockwise as a unit about rod 178 against the bias of a return spring 180, thereby to selectively lower the printing wheels into disengaged relation with the strip.

To effect precision edge folding along longitudinal side edges 27 of strip 24, such that its outer printed surface 24A is folded over in a fashion to simulate a headband on the integrated lining, the printed strip is drawn along its feed path upon emerging from printing station 64 and into crimping station 66 between upper and lower mating crimp rolls 182, 184. As best seen in FIG. 14, upper crimp roll 182 is rotatably mounted on adjustment arms such as the one at 186 which in turn are supported on frame 56 and may be moved into a desired axially parallel position relative to lower crimp roll 184 within limits established by an oversized opening at 188 in the adjustment arm 186 for receiving a shank of a releasable fastener 190. Upon adjusting the axial location of upper crimp roll 182 relative to lower crimp roll 184, fold lines 28 are formed on inner strip surface 24B as strip 24 passes between crimping rolls 182, 184.

The mating scoring faces on the crimping rolls 182, 184 also may be adjusted laterally for accommodating book spine lengths of different size such that fold lines 28 scored during passage of srip 24 over lower crimping roll 184 extend longitudinally and in parallel adjacent relation to side strip edges 27 and within printing zones 26 of the simulated headbands on the opposite outer surface 24A of strip 24.

Upon being scored, strip 24 is drawn into glue station 68 (FIG. 16). A roll 192 is rotatably supported between frame side walls 194, 196 and over which roll 192 the strip 24 is trained to pass over a pair of glue wheels 198, 198 for engaging strip 24 and for applying a suitable adhesive, such as a hot melt adhesive, preferably between each fold line 28 and its adjacent side edge 27.

In the specifically illustrated embodiment the glue wheels 198, 198 are each secured by pins 200 to shafts 202 rotatably supported on individual hot melt containers 204 for each glue wheel 198, 198. The shafts 202 each are shown with an input gear 206 in mesh with a drive gear 208 secured by a key 210 to the above mentioned glue drive shaft 142 rotatably supported on frame side wall 194, 196 and power operated by slave belt 138. To selectively vary the spacing between the two coaxialy aligned glue wheels 198, 198 for different strip widths, each drive gear 208 is preferably keyed to drive shaft 142 for rotation therewith while permitting axial movement of the drive gears 208, 208 on the shaft 142 laterally of the strip feed path. For this purpose, each hot melt container 204 is adjustable in its entirety on the glue drive shaft 142, e.g., by means of the illustrated releasable fastener 212 threadably extending through a mounting block 214 fixed to the container 204 for sliding movement on a complementary mounting bar 216 serving as a supporting frame member for the adhesive applicator. Upon tightening down the fastener 212, each hot melt container 204 is releasably secured in a selected laterally adjusted position on the bar 216.

To promote trouble-free application of adhesive to inner strip surface 24B, the above described adhesive applicator 68 is automatically deactivated by the control systems at the same time feed control cylinder 120 is operated to disable feed roll assembly 76. An adhesive control cylinder 218 is mounted on frame 56 with a reciprocable piston rod 220 connected to a free end of an extension bar 222 integrally connected to the adhesive applicator bar 216 and supported for pivoting movement on glue drive shaft 142. During normal machine cycling, piston rod 220 is in a retracted position illustrated in FIGS. 14 and 16 with glue wheels 198, 198 in contact with strip 24 passing over roll 192. Upon disabling feed roll assembly 76, the supply and exhaust to the adhesive control cylinder 218 is also reversed by the control systems to extend piston rod 220 and pivot the adhesive applicator device 68 in its entirety about glue drive shaft 142 in a clockwise direction as viewed in FIG. 14 against the bias of spring 224 to disengage glue wheels 198, 198 from strip 24. The supply and exhaust connections to cylinder 218 are once again reversed in timed relation to feed control cylinder 120 upon again commencing normal machine operation to retract piston rod 220 and pivot the adhesive applicator device 68 counterclockwise into its illustrated operative position with the glue wheels 198, 198 engaging strip 24 passing over roll 192.

By virtue of the above described construction, glue wheels 198, 198 may be intermittently operated in timed relation to feed roll assembly 76 at a surface speed somewhat greater than the surface speed of strip 24 passing over roll 192 thereby to provide a power assist in feeding the strip along its feed path as well as to effect efficient transfer of hot melt adhesive from each container onto strip surface 24B. Suitable heaters, not shown, are provided in each container 204 to maintain the adhesive at a selected temperature.

To fold strip 24 along its fold lines 28 to bring the inner edge portions of surface 24B into confronting engagement, the strip emerging from glue station 68 is drawn into folding station 70 (FIGS. 17 and 18). The strip edges 27 engage contoured plow blades 226, 226 extending generally parallel to the strip feed path and spaced apart in fixed relation to one another on mounting brackets such as the one shown at 228. Bracket 228 is secured to a laterally extending mounting cross bar 230.

As best seen in FIG. 18, mounting bracket 228 is adjustably secured to cross bar 230 by a releasable fastener 232 in a selected lateral position relative to the strip feed path for ensuring that the contoured plow blade 226 supported on the bracket 228 is properly positioned relative to its mating plow blade for engaging, lifting and turning over opposite side edges 27 of the strip 24 during its advance movement through the edge folding device 70. To ensure that the folded confronting inner surfaces 24B at each side edge of the strip are efficiently bonded, the blades 226 are each contoured to turn over side edges 27 in a 180° fold. Upon emerging from the edge folding device, pressure is preferably applied to the folded edges and, in the preferred embodiment, such pressure is effected upon passage of the edge folded strip over downstream roll 234 which additionally ensures a securely bonded edge fold.

To promote a crisp folded edge about the fold lines 28, a hold-down leaf spring 236 is provided in the strip feed path on an inboard side of each fold line 28 and a third hold-down leaf spring 238 is illustrated in FIG. 18 between springs 236, 236. Each leaf spring extends from a flat on a collar 240 mounted at selected lateral and angular positions on the cross bar 230 to provide a preslected spring force urging the strip 24 into pressing engagement against a back plate 242 supported on frame 56.

To provide desired bulk and improved appearance to each simulated headband 26, cord 32 is threaded from a supply spool 244 through eyes of guide members 246 shown secured to the frame sidewalls 194, 196 and mounting bracket 228 to be drawn through a guide tube 248 fixed to each outboard hold-down leaf spring 236 and along the fold line 28 to be secured therein between the folded edges in timed relation to the passage of the strip 24. As best seen in FIG. 17, each guide tube 248 is fixed to its leaf spring 236 with the guide tube 248 extending in a strip advancing direction as far as possible beneath the contoured plow blade 226.

Each outboard leaf spring 236 is shown as projecting further than the guide tube 248 to restrain undesired displacement of cord 32 from the fold line 28 as the cord passes through the edge folding device. Added bulk may also be provided along the fold line by applying a controlled excess amount of adhesive which, when set, has been found to provide the desired appearance.

If desired, the cross bar 230 itself may be adjustably mounted. An adjusting knob 250 is illustrated having a shank 252 extending diametrically through the cross bar and into an opening 254 in a mounting plate 256 fixed to side wall 196 of frame 56. The adjusting knob shank 252 is a smaller diameter than its surrounding opening, and a coil spring 258 is coiled about the shank within the opening 254 and urges the cross bar 230 into a selected offset position relative to the plane of the strip feed path, thereby to selectively establish the position of the blades 226, 226 and hold-down springs 236, 236, 238 relative to the plane of the strip feed path.

Even though the machine of this invention is designed for high production relates of about 60–80 linings per minute being applied to a corresponding succession of books, the described intermittent strip indexing introduces a dwell, albeit relatively short dwell, between the time adhesive is first applied to strip 24 and when the strip is folded. To ensure a strong bond between the folded surfaces even under operating conditions wherein the extent of the advance strip movements varies and wherein a quick setting hot melt adhesive having an extremely short open time is used, the glue reactivating station 72 is provided immediately downstream of edge folding device 70. This station 72 is illustrated as having a heating unit or bar 260 utilizing conventional cartridge heaters, not shown, for radiating sufficient heat to remelt the adhesive beads between the folded strip edges 27 upon their emerging from edge folding device 70. As illustrated in FIG. 14, heater bar 260 is mounted on a pair of arms such as the one shown at 262 pivotally supported on a rod 264 secured to frame 56 on a side of the strip feed path opposite edge folding device 70. The reactivating heater bar 260 has a pin 266 for securing one end of a suitably anchored return spring 268. The position of reactivating heater bar 260 is controlled by a cam roller 270 supported for swinging movement about a pivot rod 272 supported on the frame sidewalls for oscillating movements in opposite angular directions responsive to swinging movements of a cam operator link 274 fixed to an extendible and retractable piston rod 276 operated by a heater control cylinder 278. The cam roller 270 engages a back face of the heat bar 260 which is maintained in following engagement with the cam roller 270 by the spring 268.

As the strip 24 is fed along its feed path, the reactivating heater bar 260 is maintained in its position illustrated in FIGS. 14 and 18 to apply heat to melt the glue previously applied to the linings before the edges were folded in. Reactivating the glue reseals the edges in folded position and upon disabling feed roll assembly 76 to stop machine cycling, the supply and exhaust to the heater control cylinder 278 is reversed by the control systems. This action retracts piston rod 276 from the operative position shown in FIG. 14, and swings heater bar 260 counterclockwise into a withdrawn dwell position in timed relation to the disabling of the feed roll assembly 76 and the adhesive applicator 68 by their respective control cylinders 120 and 218.

Upon again advancing strip 24 upon commencing normal machine cycling, the piston rod 276 is extended by the control systems to drive the cam roller 270 in a clockwise direction to move the reactivating heater bar 260 toward the lining to again apply heat to melt or reactivate the glue which was applied to the lining before folding in its edges, thereby to securely seal the edges in folded position.

It is to be noted that cartridge heaters not only for the reactivating heater bar 260 but also for the hot melt adhesive containers 204 are provided in accordance with conventional techniques and are actuated by selector switches within the control box 86 and are thereafter controlled to preset temperatures by standard thermostats, not shown.

In accordance with yet another feature of this invention, strip 24 advances from the glue reactivating station 72 to the downstream punching station 74 which will be understood to include a pair of aligned conventional punches 280, 280 selectively positioned along an upper run of the strip feed path at the top of the frame 56. The punches 280 are powered by solenoid operated air cylinders 282 to simultaneously effect a punching action during each dwell in the machine cycling. A piston rod 284 to which punches such as 286 are mounted is retracted into a withdrawn starting position as illustrated in FIG. 14 prior to each advance strip feeding movement. Punches 280, 280 are mounted on traversing carriages 288, 288 respectively supporting punches 280, 280 with each of the traversing carriages being supported on frame 56 for movement and having releasable locking devices 290, 292 for securing the punches 280, 280 in selected position. More specifically, a pair of fixed cross rods 294, 294 extend laterally across the strip feed path and are secured in position at the top of the frame 56 by brackets 296. Movable longitudinal bars 298, 298 are mounted on the cross rods 294, 294 with each bar 298 having a rod receiving opening at a bifurcated end of the cross bar (FIG. 14) to permit its being slidably positioned laterally of the strip feed path. The releasable locking devices 292 provided at each bifurcated end of the cross bars 298, 298 are of conventional construction and may be tightened to secure each cross bar 298 in selected position in accordance with the folded width of the strip 24 being fed to punching station 74. Each punch 280 in turn is mounted on its cross bar 298 by an adjustable mounting bracket 300 which is releasably secured in adjusted position longitudinally of its cross bar 298 for precise positioning of the punch 280 in relation to the longitudinal side edge of the strip 24 and the other punch 280.

The above construction provides for the punches 280, 280 to be independently and precisely positioned both parallel to and laterally of the longitudinal strip axis for punching marginal cutouts 34 uniformly spaced apart along each folded side edge of the strip 24 and in aligned opposed relation to cutouts 34 on its opposite side edges. Precise positioning of the punches 280, 280 longitudinally of the strip feed path ensures that linings of identical dimension are cut during each dwell in the machine cycling. Upon precisely locating each punch 280 in the feed path upstream of the cutter 78 at a distance equally divisible by a measured extent of the strip movements which correspond to the width of the lining 38 which is preselected in relation to the thickness of the books to which the linings are to be applied.

The cutter operates during each dwell between strip movements for successively cutting the printed and punched strip transversely of its longitudinal axis along a cutoff line extending between centers of opposed marginal cutouts 34 to provide a series of integrated linings to be attached to a corresponding succession of books being delivered to the lining platform 80.

As described above, the extent of each advancing strip movement is determined by the clockwise driving movement of gear segment 88 which movement is adjustable upon adjusting the linkage between gear segment 88 and drive shaft 94 to selectively vary the feeding cycle in accordance with a selected book thickness. If desired, other means of controlling the lining feed at the integrated lining station may be used. As seen in FIG. 20, use may be made, e.g., of the printed lines simulating the headbands to actuate a suitable predetermining counter 300 by a conventional photo-electric pickup device 302. Assuming that each row of simulated headbands contains 20 lines per linear inch, an integrated lining for a 3-inch thick book, for example, would have 60 lines across the thickness of the book and a total of 35 additional lines for the two side flaps, each of which measure ⅛ inch, for a total of 95 lines. Upon setting the predetermining counter 300 to energize a relay R upon reaching a 95 count, the photo-electric pickup device 302 will produce 95 pulses upon advancing strip movement, which pulses are fed through a conventional amplifier A in a well-known manner to counter 300 which at the count of 95, energizes relay R. Upon being energized, relay R unclamps feed roll assembly 76 through any suitable means such as solenoid operated valve V, schematically illustrated in FIG. 20, to stop the feeding of the lining, and to permit the lower knife 82 to be operated to cutoff the predetermined length of lining on platform 80 to be applied to a book 36. Alternatively, a conventional electric clutch and brake, not shown, may be used rather than the illustrated mechanical components to control feeding in accordance with well-known techniques, whereby the clutch is energized by a cam switch, not shown, suitably mounted on frame 56 and set to initiate feeding at a proper point in the normal machine cycling. The brake is then energized by relay R at the count of ninety-five for a three inch thick book, effecting a dwell in the feeding during which a lining is cutoff and applied to a book prior to the next advancing strip movement.

An apparatus of the type disclosed has been found to operate satisfactorily at production rates of 60 to 80 books per minute with the quantity of adhesive used reduced to about 50% required by conventional linings and with more than a 50% reduction in material costs by elimination of conventional headbands, woven crash and backlining paper. Concomitant savings are achieved by reducing the size of a conventional backlining station by approximately 50% upon installing the disclosed integrated lining apparatus of this invention.

To provide added bulk along fold lines 28 by means other than cord 32, a glue wheel such as the one shown at 198A in FIG. 23 may be secured to each shaft 202 rotatably supported on its respective individual hot melt container 204, it being understood that the other components of the glue statin 68 are substantially the same as described above and function as previously described. Each glue wheel 198A has a groove 310 circumferentially extending about its periphery in offset relation to a central plane perpendicular to the axis of rotation of wheel 198A. The groove 310 in each glue wheel 198A is adjacent its outside edge and is disposed during machine setup just inside fold line 28 scored on strip 24. Upon the adhesive being applied to strip 24 by the peripheral surface of roll 198A, a continuous thin layer 30A of molten adhesive is deposited which corresponds to the outer surface of the glue wheel 198A with a raised bead 30B of enlarged cross section (FIG. 24C) provided by groove 310 to extend parallel to longitudinal side edge 27 of strip 24.

After the gluing step (FIGS. 24A and 24B), the side edges 27 of strip 24 are folded over along their scored fold line 28 (FIGS. 25A and 25B) as previously described, and the marginal inner surfaces 24B between the fold lines 28 and side edges 27 are effectively bonded by the hot melt adhesive 30A with its raised head 30B providing the desired added bulk to the simulated headbands 44 of the linings 38 (FIG. 12). Thereafter, the heating step, if necessary, may be undertaken (FIGS. 26A and 26B) to reactivate or remelt the adhesive to securely seal the folded edges in position as described above.

To control the thickness of the adhesive layer 30A and the size of its bead 30B, a scraper 312 is mounted on container 204 (FIG. 23). Any suitable means such as the fastener 314 illustrated as being attached to scraper 312 and threadably engaged with a wall of container 204 may be provided to move scraper 312 toward and away from the peripheral glue applying edge of each wheel 198A.

Figure 27A:
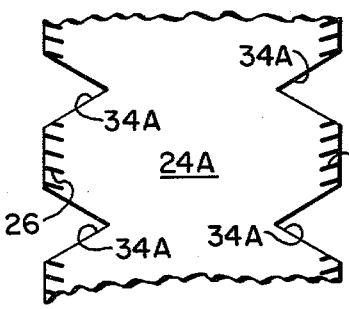
Figure 27B:
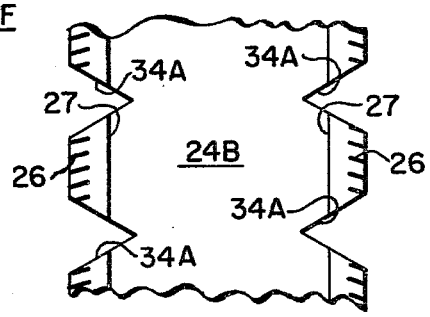

The sealed edge folded strip 24 then is relieved to provide cutouts 34A illustrated as being V-shaped in FIGS. 27A and 27B. The cutouts 34A will be understood to be of any suitable shape to effect stress relief at each corner of the side flaps 46 of the integrated lining 38 as prevously described. Moreover, the step of forming the marginal cutouts along each edge of the strip may be produced by burning or melting the strip 24 with a hot wire, e.g., or by any other suitable means such as the previously described apparatus at punching station 74.

Figure 28A:
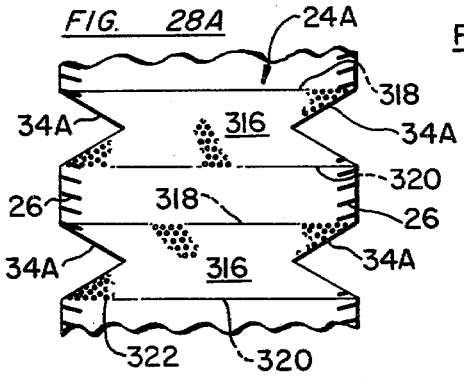
Figure 28B:
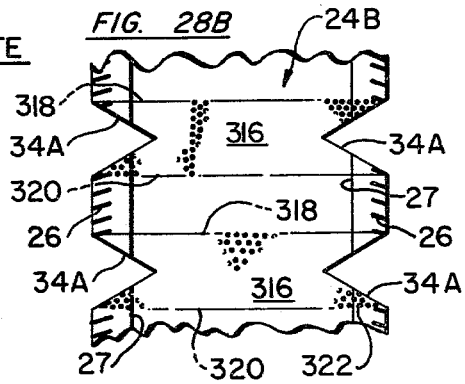
Figure 29A:
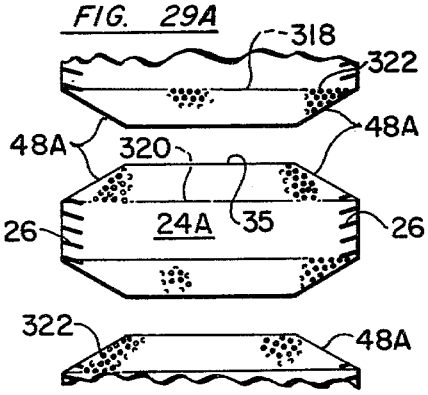
Figure 29B:
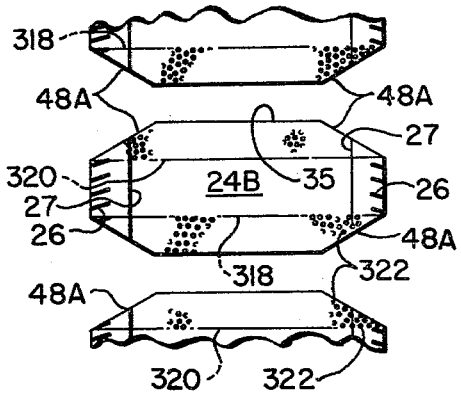

In accordance with yet another aspect of this invention, longitudinally spaced apart regions 316 of strip 24 (defined by aligned, opposed pairs of cutouts 34A and transversely extending projections 318, 320 between corresponding corners of the cutouts 34A as best seen in FIGS. 28A and 28B) are perforated. Perforation of these regions 316 provides for subsequent glue penetration through an otherwise impervious portion of the material of strip 24 which later define the side flaps 46 of the integrated lining 38. Accordingly, in a later operation of the book binding process following the cutting step (FIGS. 29A and 29B) and after the linings 38 have been applied to the books 36, only a single application of glue is required to bond not only side flaps 46 to end sheets 42 of each book 36 but also book 36 to its cover (not shown). Efficiency of such operation is achieved since glue permeating the side flaps 46 secures them to the end sheets 42 and the portion of the glue on the outside of the side flaps 46 glues the flaps to the book cover. By providing perforation 322 in the defined regions 316, later comprising side flaps 46, the same book making apparatus and method now used with conventional "crash" back lining may also be used with the integrated back lining 38 of this invention.

The perforations 322 in regions 316 are preferably sized and arranged to provide from about 40% to about 60% permeability of the material of each side flap 46. In the specifically illustrated embodiment (FIGS. 14 and 22), a suitable radiant heating device 324 is shown as being pivotally mounted on frame 56 between punching or forming station 74 and feed roll assembly 76. The radiant heating device 324 includes a conventional bar 326 provided with cartridge heaters such as at 328 (FIG. 22) connected in a well-known manner to provide the required electrical energy for heating a multiplicity of heating elements 330 shown projecting from the bar 326 toward the strip feed path for burning holes by radiation into the above defined regions 316 of the strip 24. Guide plate 332 is preferably provided in fixed relation to frame 56 to maintain strip 24 in controlled confronting relation to bar 326. Upon movement of strip 24 along its feed path into a dwell position wherein a region 316 is disposed in confronting relation to heater bar 326, the heater bar 326 is disposed in an operative position (illustrated in FIGS. 14 and 22) adjacent to but not touching the strip 24 to perforate the defined region 316 of strip 24 by radiation during the dwell portion of the machine cycle. No perforation of the strip 24 between regions 316 is effected during advancing strip movements because of insufficient time for the heater bar 326 to produce perforations, and the bar 326 accordingly may be maintained in its operative position.

In the illustrated embodiment, heater bar 326 is secured to a pair of rocker arms 334, 334 pivotally mounted on shaft 336 supported on side plates 194 and 196 of frame 56. A free end of each of the rocker arms 334, 334 is connected to a cross bar 338 drivingly connected to an extendible and retractable piston rod 340 of a power operated perforation control cylinder 342 mounted on frame 56. The supply and exhaust to perforation control cylinder 342 will be understood to be reversed by the control systems to retract piston rod 340 and pivot heater bar 326 about shaft 336 in a clockwise direction (as viewed in FIGS. 14 and 22) to automatically render the heater bar 326 ineffective with its heater bar 326 disposed in remote relation to strip 24 upon disabling feed roll assembly 76 to stop machine cycling. Once normal machine operation is again commenced, the supply and exhaust connections to the cylinder are once again operated in synchronism with the reactivation of feed roll assembly 76 to extend piston rod 340 and pivot the heating bar 326 counterclockwise into operative position before movement of the following region 316 of strip 24 into a dwell position confronting the heater bar 326.

It will be understood that other means of perforating strip 24 may be utilized, such as by either hot or cold punching or other techniques, for example, such as by hot wire melting of the strip and the like.

As will be apparent to persons skilled in the art, various modifications, adaptations and variations of the foregoing specific disclosure can be made without departing from the teachings of this invention.

I claim:

1. A method of making integrated book spine linings to be applied to spines of a succession of books and comprising the steps of providing a supply of strip lining material having a crosswise dimension between opposite longitudinal side edges generally corresponding to the book spine length, feeding a strip from the supply of lining material, printing simulated headbands on an outer surface of the strip adjacent its longitudinal side edges, folding the longitudinal side edges of the strip toward one another to expose the outer surface of the strip with the folded crosswise strip dimension between its opposite longitudinal side edges being substantially equal to the book spine length, and cutting the strip transversely to its longitudinal axis to form a succession of individual linings to be applied in registered relation respectively to spines of a corresponding succession of books.

2. The method of claim 1 wherein the cutting step occurs subsequent to the printing step.

3. The method of claim 1 further including the step of trimming the strip parallel to and along at least one of its longitudinal side edges to form a strip having a crosswise dimension between its longitudinal side edges generally corresponding to the length of book spines to which the linings are to be applied.

4. The method of claim 1 wherein the feeding of the strip is effected in one direction parallel to its longitudinal axis and occurs intermittently with substantially equal advance strip movements interrupted by a dwell, wherein the printing of the strip occurs during its advance movements to form a continuous pattern of simulated headbands parallel to and adjacent each longitudinal side edge of the strip, and wherein the cutting of the strip occurs during each dwell between advance movements of the strip to form substantially identical individual linings to be applied to book spines having substantially identical size.

5. The method of claim 4 further including the step of forming equally spaced marginal cutouts of substantially identical size along each longitudinal side edge of the strip with the cutouts along each edge of the strip being in opposed aligned relation to cutouts on the opposite edge of the strip, and wherein forming and cutting of the strip occur substantially simultaneously, the cutting being performed on a portion of the strip downstream of the forming operation.

6. The method of claim 1 further including the step of forming equally spaced marginal cutouts of substantially identical size along each longitudinal side edge of the strip with the cutouts along each edge of the strip being in opposed aligned relation to the cutouts on the opposite edge of the strip.

7. The method of claim 6 wherein the forming step provides uninterrupted longitudinal side edges between cutouts substantially equal to the thickness of book spines to which the linings are to be applied.

8. The method of claim 6 wherein the cutting of the strip is effected transversely to the longitudinal axis of the strip along a cutoff line projecting between centers of aligned cutouts on opposed strip edges.

9. The method of claim 1 further including the step of applying adhesive in a continuous bead in adjacent parallel relation to each side edge of the strip before the folding step with the adhesive serving to bond each edge of the strip in folded position and also to add bulk to the simulated headbands upon their being subsequently folded with the adhesive within each folded edge.

10. The method of claim 1 further including the step of applying the individual printed and cut linings in registered relation respectively to spines of a corresponding succession of books.

11. The method of claim 1 wherein the printing is performed on an outer surface of the strip before folding its edges, and wherein the edge folding of the strip is effected by folding over its edges with their respective outer printed surfaces exposed.

12. The method of claim 1 wherein edge folding occurs after printing but before cutting.

13. The method of claim 1 further including the step of scoring the strip in adjacnet parallel relation to each of its longitudinal side edges before folding the strip to form fold lines to facilitate folding.

14. The method of claim 12 wherein the scoring of the strip is effected along an inner surface of the strip opposite its printed surface within printing zones of its simulated headbands, the distance between the scored fold lines being substantially equal to the length of the book spines to which the linings are to be applied.

15. The method of claim 1 further including the step of feeding cord onto the strip along its side edge portions before the folding step to add bulk to the simulated headbands upon their being subsequently folded with the core within each folded edge.

16. The method of claim 1 further including the step of applying adhesive to the strip in adjacent parallel relation to each of its side edges before the folding step for bonding each edge of the strip in folded position.

17. The method of claim 16 wherein hot melt adhesive is applied in a continuous molten bead, and wherein a further step is included of heating the hot melt adhesive after folding the strip to reactivate the adhesive and promote the bond between the folded surfaces along each edge of the strip.

18. A method of making integrated linings to be applied to spines of a succession of books and comprising the steps of feeding a strip from a supply of lining material in one direction parallel to a longitudinal axis of the strip, printing simulated headbands on an outer surface of the strip during the feeding step to form a continuous pattern of simulated headbands parallel to and adjacent each longitudinal side edge of the strip, punching equally spaced marginal cutouts of substantially identical size along each longitudinal side edge of the strip with the cutouts along each edge of the strip being in opposed aligned relation to cutouts on an opposite edge of the strip and with uninterrupted longitudinal side edges between cutouts substantially equal in length to the thickness of book spines to which the linings are to be applied, and cutting the strip transversely to its longitudinal axis along a cutoff line projecting between centers of aligned cutouts on opposed strip edges to form substantially identical individual linings to be applied to book spines of substantially identical size.

19. A method of making integrated linings to be applied to spines of a succession of books and comprising the steps of feeding a strip from a supply of lining material in one direction parallel to a longitudinal axis of the strip, printing simulated headbands on an outer surface of the strip during the feeding step to form a continuous pattern of simulated headbands parallel to and adjacent each longitudinal side edge of the strip, forming equally spaced marginal cutouts of substantially identical size along each longitudinal side edge of the strip with the cutouts along each edge of the strip being in opposed aligned relation to cutouts on an opposite edge of the strip and with uninterrupted longitudinal side edges between cutouts substantially equal in length to the thickness of book spines to which the linings are to be applied, and cutting the strip transversely to its longitudinal axis along a cutoff line projecting between centers of aligned cutouts on opposed strip edges to form substantially identical individual linings to be applied to book spines of substantially identical size.

20. The method of claim 18 or claim 19 further including the step of folding longitudinal side edges of the strip toward one another after the printing step and within printing zones of its simulated headbands by folding over the edges of the strip with the outer printed surface exposed and with the folded strip dimension substantially equal to the book spine length.

21. The method of claim 20 further including the step of applying a hot melt adhesive in a continuous molten bead to the strip in adjacent parallel relation to each of its side edges before the folding step for bonding each edge of the strip in folded position.

22. The method of claim 21 further including the steps of heating the adhesive after folding the strip to reactivate the hot melt adhesive and to promote the bond between the folded surfaces along each edge of the strip and then applying pressure to the folded edges to assure a sturdy bond.

23. The method of claim 20 further including the step of scoring the strip after printing but before folding to form fold lines facilitating the folding step by scoring the strip along its inner surface opposite its outer printed surface within printing zones of its simulated headbands and in adjacent parallel relation to each of its longitudinal side edges.

24. The method of claim 20 further including the step of feeding cord onto the strip along side edge portions of the strip before the folding step to add bulk to the simulated headbands upon their being subsequently folded with the cord within each folded edge.

25. The method of claim 20 further including the step of applying adhesive in a continuous bead in adjacent parallel relation to each side edge of the strip before the folding step with the adhesive serving to bond each edge of the strip in folded position and also to add bulk to the simulated headbands upon their being subsequently folded with the adhesive within each folded edge.

26. The method of claim 18 or claim 19 or claim 5 further including the step of perforating a region of the strip defined by aligned opposed pairs of cutouts and transversely extending projections between corresponding corners thereof for said flap glue penetration upon the headbands being subsequently applied to their respective books and book covers.

27. The method of claim 26 wherein the perforating step is performed on a strip portion upstream of the cutting operation and downstream of the forming operation and occurs substantially simultaneously therewith.

28. The method of claim 26 wherein the perforating step provides perforations comprising about 50% of the area of said regions of the strip.

29. A method of making integrated linings to be applied to spines of a succession of books and comprising the steps of feeding a strip from a supply of lining material, printing simulated headbands on a surface of the strip adjacent its longitudinal side edges, cutting the strip transversely to its longitudinal axis to form a succession of individual linings to be applied in registered relation respectively to spines of a corresponding succession of books, and punching equally spaced marginal cutouts of substantially identical size along each longitudinal side edge of the strip with the cutouts along each edge of the strip being in opposed aligned relation to cutouts on the opposite edge of the strip, the feeding of the strip being effected in one direction parallel to its longitudinal axis and occurring intermittently with substantially equal advance strip movements interrupted by a dwell, the printing of the strip occuring during its advance movements to form a continuous pattern of simulated headbands parallel to and adjacent each longitudinal side edge of the strip, the cutting and punching of the strip occuring substantially simultaneously during each dwell between advance movements of the strip to form substantially identical individual linings to be applied to book spines having substantially identical size, the cutting being performed on a punched downstream portion of the strip.

30. A method of making integrated linings to be applied to spines of a succession of books and comprising the steps of feeding a strip from a supply of lining material, printing simulated headbans on a surface of the strip adjacent its longitudinal side edges, cutting the strip transversely to its longitudinal axis to form a succession of individual linings to be applied in registered relation respectively to spines of a corresponding succession of books, and punching equally spaced marginal cutouts of substantially identical size along each longitudinal side edge of the strip with the cutouts along each edge of the strip being in opposed aligned relation to the cutouts on the opposite edge of the strip.

31. The method of claim 30 wherein the punching of the strip provides uninterrupted longitudinal side edges between cutouts substantially equal to the thickness of book spines to which the linings are to be applied.

32. The method of claim 30 wherein the cutting of the strip is effected transversely to the longitudinal axis of the strip along a cutoff line projecting between centers of aligned cutouts on opposed strip edges.

* * * * *